United States Patent [19]

Birch

[11] 4,194,659

[45] Mar. 25, 1980

[54] SEAM RESPONSIVE ROLLS AND METHOD

[75] Inventor: Steven W. Birch, Monroe, N.C.

[73] Assignee: Birch Brothers Southern, Incorporated, Waxhaw, N.C.

[21] Appl. No.: 907,566

[22] Filed: May 19, 1978

Related U.S. Application Data

[63] Continuation-in-part of Ser. No. 809,427, Jun. 23, 1977, Pat. No. 4,128,212.

[51] Int. Cl.[2] ..... B65H 23/16

[52] U.S. Cl. ..... 226/35

[58] Field of Search ..... 226/35, 34, 154, 155, 226/90, 176, 177

[56] References Cited

U.S. PATENT DOCUMENTS

| | | | |
|---|---|---|---|
| 3,362,600 | 1/1968 | Rietema | 226/35 |
| 3,561,700 | 2/1971 | Adams | 226/35 |
| 3,718,269 | 2/1973 | Glaettli | 226/35 |
| 3,804,312 | 4/1974 | Lagergren | 226/35 |
| 3,854,643 | 12/1974 | Weaver | 226/35 |

*Primary Examiner*—Edward J. McCarthy

*Attorney, Agent, or Firm*—Bell, Seltzer, Park & Gibson

[57] ABSTRACT

An apparatus and method in which lengths of web material joined by widthwise seams are guided along a path of travel and between a pair of rolls arranged to form a nip. In accordance with this invention, a plurality of seam detectors are provided and the rolls are separated in response to and in predetermined relation with sensing of a seam by all of the detectors, in order to avoid damage to the rolls or to the seam portion of the fabric during handling.

12 Claims, 2 Drawing Figures

SEAM RESPONSIVE ROLLS AND METHOD

This application is a continuation-in-part of copending application Ser. No. 809,427, filed June 23, 1977, now U.S. Pat. No. 4,128,212 and entitled "SEAM RESPONSIVE SHEAR AND METHOD".

As pointed out in the aforementioned related application, it is common in the textile industry to handle web materials such as textile fabrics in substantially continuous lengths formed by joining together a succession of shorter lengths of web material. The shorter lengths of material are joined by transverse or widthwise seams formed by sewing or the like and have a thickness differing from that of the main body of web material.

It is also conventional for such web materials to be passed through pairs of rolls arranged to form nips. Such a nip roll arrangement may be provided for pressing liquid or the like from the web material, for imparting desired finish characteristics to the web material, or for advancing the web material along a handling path. In any such circumstances, it is conceivable that passage of the thicker seam through the nip formed by the rolls can be damaging either to the web material or to the rolls. More particularly, in certain instances, rolls are broken or deformed beyond usability by the passage of seams therethrough. In other instances, crushing of the web material in the vicinity of a seam either causes separation of the length of web material or so damages the seam portion as to require discarding a portion of the web material.

It is an object of the present invention to control separation of a pair of rolls forming a nip in such a way as to minimize web material waste and/or machine damage. In realizing this object of the present invention, a plurality of seam detectors are provided and are mounted adjacent the path of travel of web material to and through a nip. Each of the detectors senses widthwise seams in web material guided along the path of travel. A control is operatively connected to the detectors and to means for separating the rolls for separating the rolls in response to and in predetermined relation with seam sensing.

A further object of the present invention is to minimize false indications of seam detection by requiring substantial coincidence among seam signals from all of a plurality of detectors. In realizing this object of the present invention, a distinction is drawn between the signalling by all of a plurality of detectors within a predetermined interval of time and indicative of a web material widthwise seam and signalling by less than all of the detectors and indicative of false seam sensing.

BRIEF DESCRIPTION OF THE DRAWINGS

Some of the objects of the invention having been stated, other objects will appear as the description proceeds when taken in connection with the accompanying drawings, in which.

DETAILED DESCRIPTION

Referring more specifically to the drawings, the novel web handling apparatus for carrying out the method of this invention is generally designated at 10 and includes nip roll means, broadly designated at 11, which may take various forms. By way of example, the nip roll means 11 may be of types such as may be present in calendering, dyeing, washing, folding or other treating apparatus wherein, in some instances, it is desirable, if not necessary, that the nip roll means be capable of "jumping" seams in the fabric or other web material W in order to avoid waste and/or apparatus down time. The web handling apparatus 10 may include any suitable means, not shown, for guiding and advancing the web material W, joined by widthwise seams, along a predetermined path of travel while performing a desired operation or treatment on the web material. Such operations or treatments may include any one or more of those mentioned above and are well known to persons skilled in the applicable arts.

Figure 1:
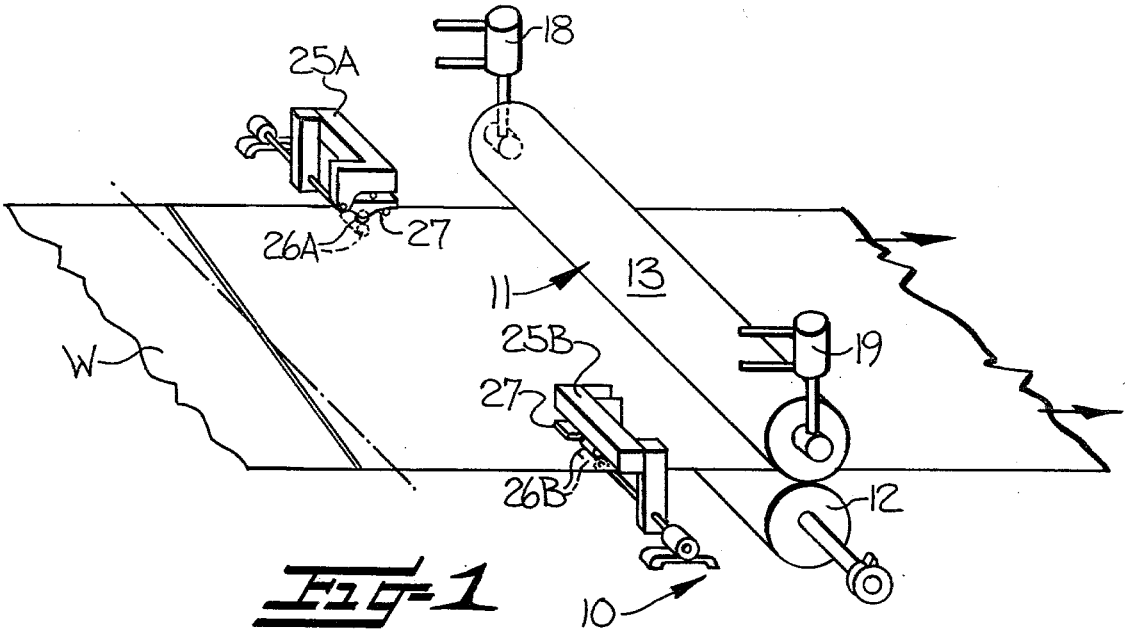
FIG. 1 is a schematic perspective view of a preferred embodiment of the invention in association with nip roll means of a web handling apparatus.

In any event, it will be observed in FIG. 1 that the web material W passes through the nip roll means 11 in its course into, through and/or out of the web handling apparatus 10. Such nip roll means may include a pair of cooperating lower and upper nip rolls 12, 13. Although the nip rolls 12, 13 are shown one above the other, it is apparent that they may be disposed in side-by-side or angular relationship without departing from this invention.

In accordance with the invention, actuating means are provided for disengaging the web material W and the nip roll means 11. In the form illustrated, this means takes the form of a pair of cylinders 18, 19 acting on one or the other or both of the nip rolls 12, 13 to separate them from fabric passing between the nip rolls 12, 13. As shown, the cylinders 18, 19 are operatively associated with the upper nip roll 13.

In accordance with the present invention and in order to avoid undesired pressing of a seam by the nip roll means 11 and to thereby avoid damage to the nip roll means and/or the material passing therebetween, the apparatus 10 incorporates improvements which control actuation of the cylinders 18, 19. More particularly, the present invention contemplates that a plurality of seam detector means be mounted adjacent the path of travel of web material W to the nip roll location, with each of the detectors sensing widthwise seams in web material guided along the path. In the particular form illustrated, a pair of seam detectors 25A, 25B are provided having respective pairs of rolls 26A, 26B forming nips through which the web material W passes. One of the rolls of each pair 26A, 26B is mounted on a respective pivoting arm 27 so as to be movable to open the nip. Upon such movement of either pivot arm 27, an associated electrical switch is closed, thereby electrically signalling passage of a thickened portion of the web material, usually, a widthwise seam. A more detailed disclosure of the detector means is given in the copending parent application. However, while this electromechanical form of seam detector has been chosen for illustration and description, persons skilled in the applicable arts will recognize that other sensor or detector means may be provided for responding to increased thickness or other characteristics indicative of a widthwise seam in the web material W.

In further accordance with the present invention, a control means is operatively connected to the detector means and to the nip roll means 11 for actuating the nip roll means 11 in response to and in predetermined relation with seam sensing by all of the detector means. In the particular form illustrated, where two seam detectors 25A, 25B are provided adjacent opposite longitudinal edges of the web material W and which electrically signal passage of a widthwise seam, the control means takes the form of an electrical circuit as schematically shown in FIG. 2.

The control means comprises coincidence means for distinguishing between signalling by both of the seam detectors 25A, 25B within a predetermined interval of time and indicative of a web material widthwise seam having passed therethrough, and signalling by less than all of the detector means and indicative of false seam sensing by that one detector means. The control means additionally comprises a delay means responsive to forward movement toward a taking-up position of a length of web material equal to a predetermined distance by which the seam detectors 25A, 25B are spaced along the path of travel of the web material W from the nip roll location. The delay means is responsive to seam sensing by the detectors 25A, 25B and to web material movement for causing action which separates the nip roll means and the web material W.

Figure 2:
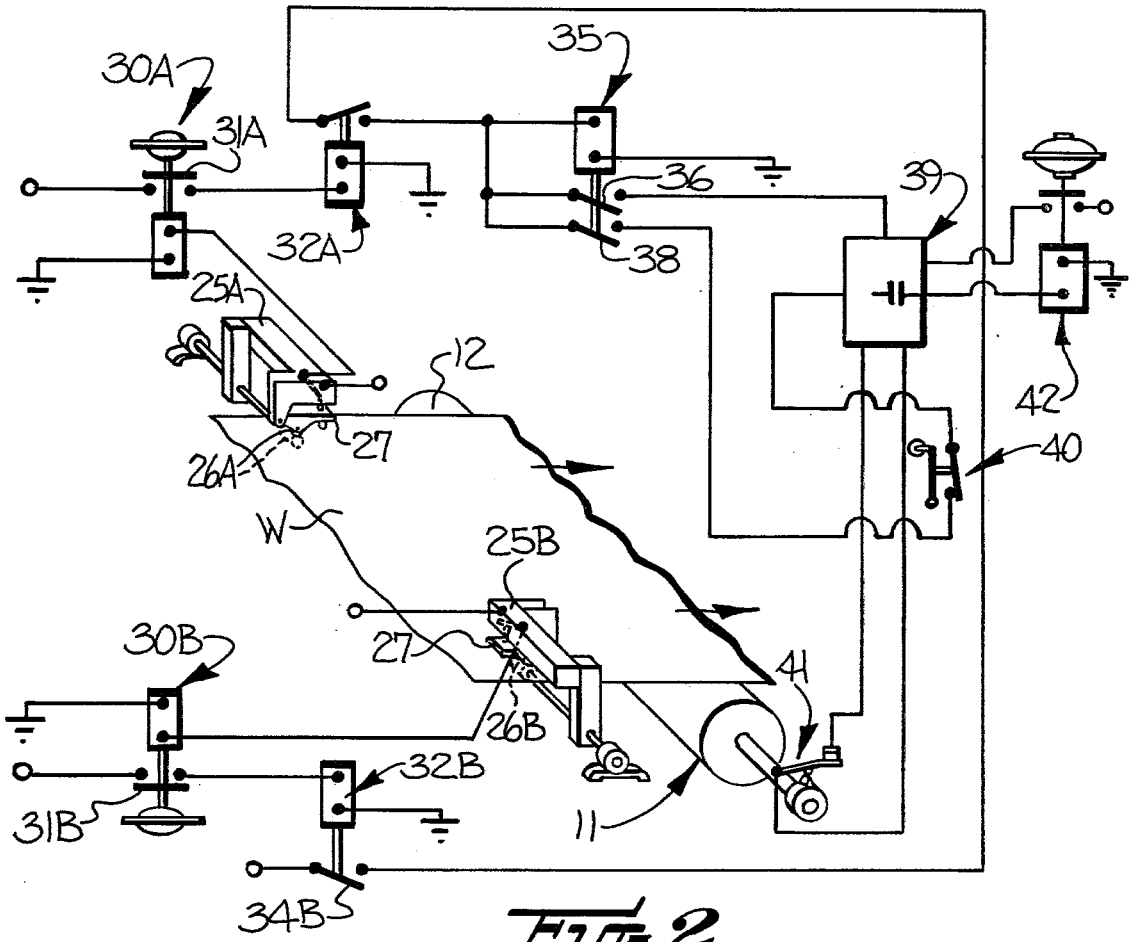
FIG. 2 is a schematic diagram of a control means for the nip roll means of FIG. 1.

Referring now more particularly to FIG. 2, each of the seam detectors 25A, 25B is electrically connected with a corresponding time delay relay 30A, 30B of the type which closes promptly upon completion of a circuit through the corresponding electrical switch of a seam detector, but which does not reopen until passage of an adjusted, predetermined time interval, on the order of one to ten seconds. Electromechanical relays of this general type are known to persons skilled in the appropriate electrical arts and accordingly need not be disclosed in full detail. Each of the time delay relays 30A, 30B has a normally open contact set, respectively indicated at 31A, 31B, and which respectively energize the windings of coincidence determining relays 32A, 32B. The coincidence relays 32A, 32B are provided with respective normally open contact sets 34A, 34B electrically interconnected in series with each other. As will be appreciated, closure of the normally open contact sets 31A, 31B of the delay relays 30A, 30B coincidentally or in an overlapping time period, as determined by the adjusted delay thereof, will result in conductance of electrical energy through the series connected normally open contact sets 34A, 34B of the coincidence relays 32A, 32B.

With completion of a circuit through the normally open contact sets 34A, 34B of the coincidence relays 32A, 32B, the winding of a control relay 35 is energized, and normally open contact sets 36, 38 thereof energize a counter 39 and a limit switch 40 responsive to movement of the nip roll means. The counter 39 is electrically connected with a counting head 41 which, as described in U.S. Pat. No. 3,167,268, for example, constitutes a web material movement signalling means for generating pulse signals in proportion to forward movement of incremental lengths of web material along its path of travel.

The counter 39, when enabled through the corresponding contact set 36 of the control relay 35, counts such number of pulse signals from the counting head 41 as represent a predetermined length of web material equal to the predetermined distance by which the seam detectors 25A, 25B are spaced along the path of web material travel from the nip roll means. Upon counting of such number of pulse signals, the counter 39 completes an internal electrical circuit effective for separating the nip roll means and the fabric passing therebetween as by moving the upper nip roll 13 upwardly away from the lower nip roll 12 and the web material W passing therebetween. With such separating movement, the limit switch 40 operates to deenergize the winding of control relay 35 and to reset the counter 39 to a zero condition of having counted no pulse signals.

It is preferred that counter 39 and limit switch 40 are electrically and operatively connected to an adjustable time delay mechanism 42 so arranged as to delay the effect of limit switch 40 in deenergizing the winding of control relay 35 for a predetermined interval of time. Thus, following each actuation of the nip roll separating means 18, 19, the nip rolls 12, 13 will remain in their separated condition for a predetermined period, such as to provide time for a skewed seam to pass between the nip rolls 12, 13 before the upper nip roll 13 returns to its normal lowered position in engagement with the web W passing between the nip rolls 12, 13.

As will be appreciated, in the event that one of the two seam detectors 25A, 25B falsely signals detection of a widthwise seam, only one of the coincidence relays 32A, 32B would be energized. Due to the series connection of the normally open contact sets 34A, 34B thereof, the winding of control relay 35 would not be energized and counter 39 would not be enabled to respond to the counting head 41 by calling for actuation of the nip roll separating means 18, 19. Further, it will be appreciated that the delay accomplished by the time delay relays 30A, 30B permits jumping a seam in web material W even under circumstances where a seam is skewed and is not in a truly transverse position widthwise of the web material. That is, signalling by a first one of the seam detectors 25A, 25B establishes the beginning of a predetermined time period (mentioned above as being up to ten seconds) within which signalling by the other of the seam detectors 25A, 25B will lead to completion of the circuit energizing the control relay 35 and the consequent operation of the nip roll separating means in predetermined relation with the signalling of the sensing of a seam. Conversely, failure of the other seam detector to signal within the predetemined time period leads to an automatic resetting or recycling of the control upon expiration of the time period.

In the drawings and specification, there has been set forth a preferred embodiment of the invention, and although specific terms are employed, they are used in a generic and descriptive sense only and not for purposes of limitation.

That which is claimed is:

1. In a web material handling apparatus having means for guiding lengths of web material joined by widthwise seams along a path of travel, and nip roll means for engaging web material at a predetermined position along the path of travel, an improvement which controls operation of the nip roll means for of seam detector means mounted adjacent said path of travel, upstream of said nip roll means position, each for sensing widthwise seams in web material guided along said path of travel toward said nip roll means position, and control means operatively connected to said detector means and to said nip roll means for separating said nip roll means relative to web material in response to and in predetermined relation with seam sensing by all of said detector means.

2. Apparatus according to claim 1 wherein said detector means are spaced at a predetermined distance along said path of travel from said nip roll means and further wherein said control means comprises delay means responsive to movement toward said nip roll position of a length of web material equal to said predetermined distance and to seam sensing by all said detector means for separating said nip roll means relative to the web material upon movement of a sensed seam from said detector means to said nip roll means.

3. Apparatus according to claim 2 wherein said delay means comprises web material movement signalling means for generating pulse signals in proportion to movement of incremental lengths of web material along said path of travel, and counter means responsive to said detector means and to said signalling means for counting such number of pulse signals as represent said predetermined length of web material.

4. Apparatus according to claim 1 wherein said detector means generate a signal in response to seam sensing and further wherein said control means comprises coincidence means for distinguishing between signalling by all of said detector means within a predetermined interval of time and indicative of sensing of a web material widthwise seam and signalling by less than all of said detector means and indicative of a false seam sensing signal.

5. Apparatus according to claim 4 where said coincidence means comprises timer means responsive to signalling by a first actuated detector means for timing said predetermined interval of time and means responsive to said timer means for permitting a later actuated detector means to actuate said nip roll means.

6. In a web handling apparatus for web material such as textile fabric and having means for guiding and advancing lengths of web material joined by widthwise seams along a path of travel, and a pair of cooperating nip rolls between which the web material is advanced at a predetermined position along its path of travel; an improvement which controls the relation between the nip rolls for jumping seams in the web material and comprising: a plurality of seam detector means mounted adjacent said path of travel upstream of said pair of nip rolls, each of said seam detector means being adapted to sense widthwise seams in the web material advancing along said path of travel toward said nip rolls, and control means operatively connected to said detector means and to at least one of said nip rolls for separating the same from the other nip roll and from the web material in response to and in predetermined relation with seam sensing by all of said detector means.

7. Apparatus according to claim 6 wherein said detector means comprise a pair of detectors mounted adjacent respective marginal side edge portions of said path of travel and aligned transversely of web material moving therealong.

8. Apparatus according to claim 7 wherein said detector means comprise means for sensing variations in thickness of web material as indicative of passage of a widthwise seam.

9. Apparatus according to claim 8 wherein said detector means comprise a pair of rolls defining a nip for passage of web material therethrough and electrical switch means responsive to increased separation of said rolls by passage of a thickened seam therebetween for electrically signalling sensing of a seam.

10. In a web handling apparatus having means for guiding lengths of web material joined by widthwise seams along a path of travel, and a pair of cooperating nip rolls between which the web material is advanced at a predetermined position along its path of travel; an improvement comprising: a plurality of detector means mounted adjacent said path of travel, each for signalling electrically the passage thereby of widthwise seams in web material guided along said path of travel toward said nip rolls, coincidence circuit means electrically connected to said detector means for distinguishing between signalling by all of said detector means within a predetermined interval of time and indicative of the passage of a widthwise seam and signalling by less than all of said detector means and indicative of a false signal from at least one detector means, and control relay means electrically connected to said coincidence circuit means and operatively connected to at least one of said nip rolls for separating said nip rolls in response to signalling by all of said detector means.

11. In a method of handling lengths of web material joined by widthwise seams which includes guiding the material along a path of travel and engaging the material with a pair of nip rolls, an improvement comprising sensing at a plurality of points along the path of travel the passage of a widthwise seam, and responding to and in predetermined relation with the sensing of a seam at all of the points by separating the nip rolls.

12. In a method of handling lengths of web material joined by widthwise seams which includes guiding the material along a path of travel and through a nip formed by a pair of rolls, an improvement comprising sensing the passage of a widthwise seam at a point along the path of travel spaced at a predetermined distance from the nip, responding to the sensed passage of a seam by measuring the length of material moving along the path, and moving at least one roll relative to the material in response to the measured length of material equaling the predetermined distance so as to separate the rolls and open the nip in the area of the seam.

* * * * *

UNITED STATES PATENT AND TRADEMARK OFFICE

CERTIFICATE OF CORRECTION

PATENT NO. : 4,194,659

DATED : March 25, 1980

INVENTOR(S) : Steven W. Birch

It is certified that error appears in the above-identified patent and that said Letters Patent are hereby corrected as shown below:

Column 4, line 53, after the word "for" insert - jumping seams in the web material and comprising: a plurality -.

Signed and Sealed this

*Fifth* Day of *August 1980*

[SEAL]

*Attest:*

SIDNEY A. DIAMOND

*Attesting Officer*

*Commissioner of Patents and Trademarks*